United States Patent [19]

Musgrave et al.

[11] 4,333,291

[45] Jun. 8, 1982

[54] INSULATED ROOF STRUCTURE

[75] Inventors: Dwight S. Musgrave, Granville; John D. McMahan, Newark; Robert L. Downing, S. Vienna, all of Ohio

[73] Assignee: Owens-Corning Fiberglas Corporation, Toledo, Ohio

[21] Appl. No.: 172,876

[22] Filed: Jul. 28, 1980

[51] Int. Cl.[3] ..... E04B 1/74

[52] U.S. Cl. ..... 52/404; 52/410; 52/483; 52/486

[58] Field of Search ..... 52/407, 410, 404, 483, 52/714, 486

[56] References Cited

U.S. PATENT DOCUMENTS

| | | | |
|---|---|---|---|
| 4,044,521 | 8/1977 | Fischer et al. | 52/404 |
| 4,047,345 | 9/1977 | Alderman | 52/404 |
| 4,263,763 | 4/1981 | Bouwens | 52/486 X |
| 4,275,541 | 6/1981 | Orals et al. | 52/407 X |

*Primary Examiner*—Carl D. Friedman

*Attorney, Agent, or Firm*—Ronald C. Hudgens; Philip R. Cloutier; Paul J. Rose

[57] ABSTRACT

The roof structure (10) comprises spaced parallel I-beams (12), spaced parallel generally Z-shaped purlins (14) extending transversely of and supported by the I-beams (12), insulation support members (16) hung on the purlins (14), fibrous glass boards (24) with facing (25) supported by the insulation support members (16) beneath the purlins (14), fibrous glass batts (26) covering the boards (24) between the purlins (14), and roof panels (28) secured to the purlins (14) and covering the batts (26), each insulation support member (16) comprising an elongated board-edge sealing member (20) supported respectively adjacent opposite ends by a pair of hangers (18) hung on a purlin (14) and each having a pair of guide and support arms (22) respectively extending oppositely therefrom transversely of the board-edge sealing member (20).

2 Claims, 4 Drawing Figures

INSULATED ROOF STRUCTURE

TECHNICAL FIELD

This invention relates generally to roof structures for metal buildings, and more particularly to roof structures including thermal insulation.

BACKGROUND ART

U.S. Pat. No. 4,044,521 shows a roof structure including a plurality of spaced, parallel I-beams, a plurality of spaced, parallel purlins of generally Z-shaped cross section supported by and extending crosswise of the I-beams, roof panels on top of the purlins, extruded plastic roof liner support members hooked over the lower free end portions of the purlins, corrugated roof liner panels supported at opposite edges respectively on roof liner support members on pairs of adjacent spaced purlins, and insulation batts between the roof liner panels and the roof panels on top of the purlins. Fibrous glass boards, faced with impervious sheet material to provide a vapor seal, have been used in place of the corrugated roof liner panels.

DISCLOSURE OF INVENTION

Instead of extruded plastic support members for the roof liner panels or fibrous glass boards, which extruded members are unvarying in cross section throughout their length, an assembly of stamped metal parts is provided which makes it easier to install fibrous glass boards from above during the roofing process, which provides support over a greater length of the boards between purlins, and which fastens more tightly to the purlins.

BRIEF DESCRIPTION OF DRAWINGS

The invention is described with respect to the accompanying drawings in which.

BEST MODE OF CARRYING OUT THE INVENTION

Figure 4:
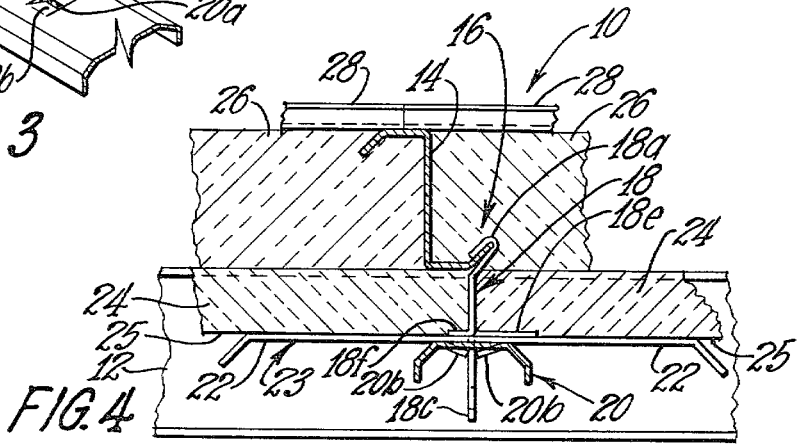
FIG. 4 is a fragmentary elevational sectional view of the insulated roof structure of FIG. 1.

With respect to the drawings, an I-beam 12 is shown in elevation in FIG. 4. A roof structure 10 constructed in accordance with the invention includes a plurality of the I-beams 12 extending parallel to each other and spaced about twenty-five feet apart, each I-beam 12 being supported by suitable posts (not shown).

Figure 1:
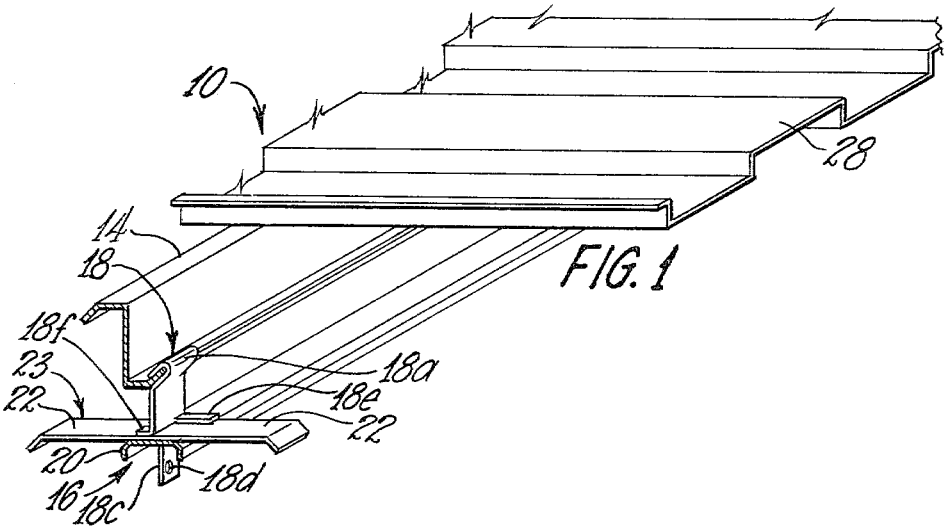
FIG. 1 is a fragmentary perspective view of a roof structure constructed in accordance with the invention, the insulation being omitted for clarity.

A purlin 14 of generally Z-shaped cross section is shown in FIGS. 1 and 4. The roof structure 10 includes a plurality of the purlins 14 extending parallel to each other and spaced about five feet apart. The purlins 14 extend crosswise of the I-beams 12, are secured to the upper portions thereof, and are supported thereby.

Figure 2:
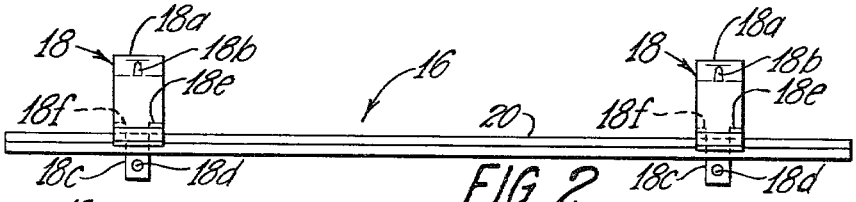
FIG. 2 is an elevational view of an insulation support member forming a portion of the insulated roof structure of FIG. 1.
Figure 3:
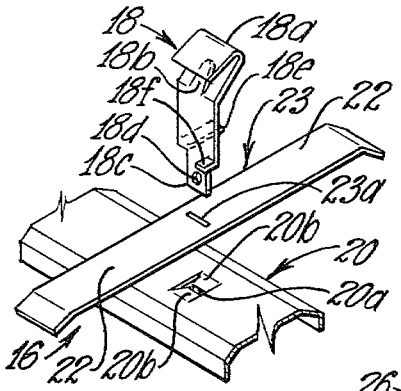
FIG. 3 is a fragmentary exploded perspective view of the insulation support member of FIG. 2.

Between each pair of adjacent I-beams 12, several insulation support members 16 (FIG. 2) are hung in a row along each of the purlins 14. Each member 16 includes a pair of spaced hangers 18 having hooked upper end portions 18*a* (FIG. 3), an elongated board-edge sealing member 20 of inverted generally channel-shaped cross section, and two pairs of transversely extending guide and support arms 22. The hangers 18 respectively support opposite end portions of the sealing member 20, and each hanger 18 has a pair of the arms 22 extending oppositely therefrom transversely of the sealing member 20.

In a cross section of each purlin 14, the lower free end portion preferably extends upwardly at an angle of about forty-five degrees from the horizontal, although it could extend upwardly at ninety degrees. The hooked end portions 18*a* of the hangers are similarly oriented and are designed to tightly grip a lower free end portion of a purlin 14. The tight grip may be provided for each hanger 18 by a resiliently bendable tab 18*b* normally extending into the space which becomes occupied by the free end portion of a purlin 14 when the hanger is mounted thereon.

In the embodiment shown, the arms 22 extending from each hanger 18 are formed as a unitary crosspiece 23. An inner roof layer is provided by a plurality of fibrous glass boards 24. Each board 24 extends between a pair of adjacent purlins 14, a row of the boards 24 extending along the purlins between each pair of I-beams 12. Each board 24 is provided with an impervious facing 25 such as plastic film and is supported adjacent one end on the arms 22 of an insulation support member 16 on one of the purlins 14 and adjacent the other end on the arms 22 of an insulation support member 16 on the other purlin 14 of the pair of adjacent purlins. The boards 24 may be about five feet long and may be furnished in two-foot and three-foot widths. Insulation support members 16 may be furnished with two-foot and three-foot lengths of board-edge sealing members 20. A vapor seal is provided where the facing 25 of a board rests on the respective board-edge sealing member 20. The facing 25 of each board 24 is wrapped around opposite longitudinal edge portions of the board and sealed to the back thereof, providing a vapor seal where one board 24 engages another.

Batts 26 of fibrous glass insulation, of lower density than the density of the boards 24, are mounted on top of the boards 24 and covered by roof panels 28 secured to the purlins 14.

In the embodiment shown, the insulation support members 16 can be assembled by hand at the building site. Each of the board-edge sealing members 20 is provided respectively adjacent opposite ends with a pair of apertures 20*a* each formed by shearing the member 20 in an H-pattern and bending a pair of opposite tabs 20*b* downwardly. Before assembly, the distance between the free ends of the tabs 20*b* is less than the thickness of the sheet stock from which the hangers 18 are made. Each crosspiece 23 is provided with an aperture 23*a* for receiving a lower tab portion 18*c* of a hanger 18. Each tab portion 18*c* is provided with a hole 18*d* which can be used, for example, for hanging electrical conduit, cables, or wires. The width of the tab portion 18*c* is determined upon the slitting of the lower portion of the hanger stock and the bending of intermediate tabs 18*e* and 18*f* oppositely upwardly through ninety degrees. The tab 18*f* is shortened to reduce stripping of the facing 25 away from a board 24 upon mounting of the board. Assembly of a member 16 involves mounting two crosspieces 23 respectively on two hangers 18 and then pushing the tab portions 18*c* of the hangers respectively through the apertures 20*a* in a board-edge sealing member 20 until the crosspieces 23 are clamped between the member 20 and the respective tabs 18*e* and 18*f*. The tabs 20*b* give slightly as the respective tab 18*c* is inserted and thereafter they grip the tab 18*c* so tightly that it is almost impossible to pull the tab 18*c* back out.

After the I-beams 12 and purlins 14 are in place, the remainder of the roof structure can be installed progressively from above. For example, working along the length of two adjacent purlins 14 from one I-beam 12 to another, one insulation support member 16 can be mounted on one purlin 14 and another can be mounted oppositely on the other purlin 14. Then one end of a board 24 can be placed on the two arms 22 of one of the members 16 and slid under the respective purlin 14 over the short tabs 18*f* of the hangers 18 while the other end of the board can be flopped down on the arms 22 of the other member 16 over the long tabs 18*e*. A batt 26 can then be placed on the board and a roof panel 28 secured thereover. From a position on top of a just-installed roof panel 28, the above steps can be repeated all along the length of the purlins.

Various modifications can be made in the structure shown and described without departing from the spirit and scope of the invention.

We claim:

1. An insulated roof structure (10) comprising a plurality of parallel horizontally extending beams (12) spaced apart from each other, a plurality of parallel horizontally extending purlins (14) spaced apart from each other, supported by and extending transversely of the beams (12), and each having a generally Z-shaped cross section with an upwardly extending lower free end portion, a plurality of insulation support members (16), each of said purlins (14) having a plurality of said insulation support members (16) hung thereon and extending longitudinally therealong in a row, each insulation support member (16) including a pair of spaced hangers (18) respectively having hooked upper end portions (18*a*) in which an upwardly extending lower free end portion of a purlin (14) is received, an elongated board-edge sealing member (20) of inverted generally channel-shaped cross section, and two pairs of horizontally extending guide and support arms (22) extending transversely of the sealing member (20), the hangers (18) respectively supporting opposite end portions of the sealing member (20) and each hanger (18) having a pair of the guide and support arms (22) extending respectively oppositely therefrom, a plurality of fibrous glass boards (24) providing an inner roof layer, each board (24) extending between a pair of adjacent purlins (14) and a row of the boards (24) extending along the adjacent purlins (14) between each pair of adjacent beams (12), each board (24) being provided with an impervious facing (25) and being supported adjacent one end on the board-edge sealing member (20) and the respective arms (22) of an insulation support member (16) on one purlin (14) of a pair of adjacent purlins (14) and being supported adjacent the other end of the board-edge sealing member (20) and the respective arms (22) of an insulation support member (16) on the other purlin (14) of the pair of adjacent purlins (14), a plurality of fibrous glass insulation batts (26) covering the inner roof layer of boards (24), and a plurality of roof panels (28) secured to the purlins (14) and covering the batts (26).

2. An insulation support member (16) for supporting fibrous glass boards (24) below the purlins (14) of a roof structure (10) wherein the purlins (14) have a generally Z-shaped cross section with an upwardly extending lower free end portion, the insulation support member (16) comprising a pair of spaced hangers (18) respectively having hooked upper end portions (18*a*) in which an upwardly extending lower free end portion of a purlin (14) is receivable, an elongated board-edge sealing member (20) of inverted generally channel-shaped cross section, and two pairs of guide and support arms (22) extending transversely of the sealing member (20), the hangers (18) respectively supporting opposite end portions of the sealing member (20) when their hooked upper end portions (18*a*) are in a mounted position on the upwardly extending lower free end portion of a purlin (14) and each hanger (18) having a pair of the guide and support arms (22) extending respectively oppositely therefrom.

* * * * *